United States Patent [19]

Katayama et al.

[11] 3,997,977

[45] Dec. 21, 1976

[54] DEVELOPING LIQUID RECOVERY DEVICE IN A COPYING MACHINE

[75] Inventors: Hajime Katayama; Koichi Miyamoto, both of Tokyo; Shoji Ohashi, Yokohama, all of Japan

[73] Assignee: Canon Kabushiki Kaisha, Tokyo, Japan

[22] Filed: Jan. 6, 1975

[21] Appl. No.: 539,230

Related U.S. Application Data

[62] Division of Ser. No. 426,054, Dec. 19, 1973, Pat. No. 3,890,721.

[30] Foreign Application Priority Data

| | | |
|---|---|---|
| Dec. 26, 1972 | Japan | 48-994 |
| Apr. 17, 1973 | Japan | 48-43493 |
| June 4, 1973 | Japan | 48-62737 |

[52] U.S. Cl. ..... 34/73; 34/77; 34/155; 118/610

[51] Int. Cl.[2] ..... F26B 21/06

[58] Field of Search ..... 34/77, 78, 155, 73, 34/72, 95; 118/602, 603, 610

[56] References Cited

UNITED STATES PATENTS

| | | | |
|---|---|---|---|
| 3,071,866 | 1/1963 | Mangus | 34/95 |
| 3,800,433 | 4/1974 | Kubodera | 34/77 |
| 3,854,224 | 12/1974 | Yamaji et al. | 34/77 |
| 3,857,189 | 12/1974 | Katayama et al. | 34/95 |
| 3,863,360 | 2/1975 | Stievenari et al. | 34/156 |
| 3,878,622 | 4/1975 | Knechtel et al. | 34/95 |

*Primary Examiner*—John J. Camby
*Assistant Examiner*—Henry C. Yuen
*Attorney, Agent, or Firm*—Fitzpatrick, Cella, Harper & Scinto

[57] ABSTRACT

In a copying machine, especially of the liquid development type, a developing liquid recovery device includes heating means for heating wet-developed copy mediums to dry and fix them, wherein developing liquid vapor is produced from the copy mediums. Condenser means is provided for cooling the developing liquid vapor by means of a heat exchanger to thereby form the vapor into mist. Mist collector means for electrically charging the mist-like developing liquid vapor collects the vapor in an electric field. Circulating means is provided for circulating an air flow through the heating means, the condenser means and the mist collector means in succession.

12 Claims, 8 Drawing Figures

DEVELOPING LIQUID RECOVERY DEVICE IN A COPYING MACHINE

This is a division of application Ser. No. 426,054, filed Dec. 19, 1973, now U.S. Pat. No. 3,890,721, issued June 24, 1975.

BACKGROUND OF THE INVENTION

1. Field of the Invention

This invention relates to a developing liquid recovery device for use in a copying machine. More particularly, it relates to a carrier liquid recovery device for use in an electrophotographic copying machine of the wet development type.

2. Description of the Prior Art

In an electrophotographic copying machine of the wet development type, it has usually been the practice to form an electrostatic latent image on a photosensitive sheet or medium as by applying of electrostatic charge and image light, directing the image-bearing sheet or medium into a pool of developing liquid composed of carrier liquid such as Isopar or like petroleum with toner dispersed therein to develop the latent image into a visible image. Where a photosensitive sheet is used, most of the developing liquid remaining thereon is then squeezed by a pair of squeeze rollers, whereafter any residual carrier liquid on the photosensitive sheet is vaporized by a fixing-drying device to fix the toner on the sheet. In case of an image transfer type copier, the toner image on the photosensitive medium is transferred to transfer medium through the agency of carrier liquid, and such transfer medium is further passed to a fixing-drying device, where the residual carrier liquid is vaporized to fix the toner image.

The carrier vapor produced in the above case is usually exhausted from the machine directly into the atomospher such as office room or the like, but even a slight amount of carrier liquid should not be neglected because it is a hygienically deleterious petroleum solvent. Especially, if a copying machine were installed in a shut-up room, the carrier vapor exhausted from the machine at a high rate per unit time would harm the health of the workers in the room inasmuch as the rate of exhaust in newer machines has a tendency toward further increase with the increasing copying speed.

Also, the amount of the carrier liquid carried away with the photosensitive sheet or the transfer sheet from the developing device is inappreciable when taken with respect to an individual sheet (0.3 to 1 cc per sheet of format A), whereas mass production of copies would involve a considerable waste of carrier liquid which should never be neglected from an economical point of view.

Recovery of carrier vapor by utilizing the adsorbing property of active carbon or by condensing the vapor has heretofore been proposed, but it is nearly impossible to attain sufficient recovery of carrier vapor by these means.

Recovery of carrier vapor by cooling and condensing the vapor has also been proposed. However, the recovered carrier liquid is heated to a high temperature in the fixing station to dry and fix the copy medium. As a result, part of the carrier liquid is thermally cracked and activated, thus producing a considerably unpleasant odor. If such odorous carrier liquid were returned to the developing liquid for repeated use, the odor would remain on copy mediums even after they have passed through the fixing-drying device, and such residual odor would finally be exhausted with copy mediums to cause unpleasant conditions for the workers in the room, although the odor might be slight in extent.

SUMMARY OF THE INVENTION

It is an object of the present invention to prevent exhaust air contaminated by the vapor of developing liquid, especially carrier liquid in an electrophotographic copying machine of the wet development type, from being discharged outwardly of the machine, and to recover the developing liquid efficiently.

It is another object of the present invention to enable the carrier vapor to be cyclically used without being discharged outwardly of the machine and to cause the carrier vapor to be condensed to a high density in a circulating system and recovered from the air to thereby eliminate the hygienic problem while, at the same time, permitting the recovered carrier liquid to be reused for development, thereby providing an economical advantage as well.

It is still another object of the present invention to provide a device which can separate the recovered carrier liquid from the water contained in the air and copy mediums and recirculate the carrier liquid alone into the developing tank for reuse.

It is yet another object of the present invention to provide a device in an electrophotographic copying machine having a carrier liquid recovery device, which device can deodor and decolor the recovered carrier liquid to make such liquid effective for reuse.

It is a further object of the present invention to enable the carrier vapor to be cyclically used without being discharged outwardly of the machine and to cause the carrier vapor to be condensed to a high density in the circulating system for recovery from the air, thereafter to pass the recovered carrier through an adsorbent such as active carbon, silica gel, active alumina, active magnesium, acid clay, bentonite, diatomite, calcium carbonate, titanium oxide or the like to thereby deodor and purify the recovered carrier liquid, thus making it ready for reuse for development.

The developing liquid recovery device of the present invention comprises a fixing-drying chamber hermetically sealed as far as possible except for the inlet and outlet ports for copy paper so that the air in the chamber may be recirculated by a blower so as to be repeatedly used for fixing and drying, while the interior of the chamber is being maintained at a pressure level below the atmospheric pressure to thereby prevent exhaust of the air containing carrier vapor. In the air circulating system, a carrier vapor recovery device is provided so that an amount of air corresponding to the amount of air admitted through the gaps of the chamber may be made hygienically harmless and exhausted outwardly of the machine. More specifically, the carrier vapor once used for fixing-drying is directed into a condenser and a mist collector for recovery of the carrier, whereafter most of the air is directed into the fixing-drying chamber by a blower for cyclical use, while the rest of the air is directed into a cooler to remove most carrier vapor therefrom before it is exhausted from the machine. The condenser comprises a flat, orthogonal flow type heat-exchanger as a first stage in which the low-temperature air subjected to carrier recovery is made into a low-temperature fluid; and a flat, orthogonal flow type heat-exchanger for making ambient air into a low-temperature fluid. The mist collector is designed to collect the mist in an electric field, the mist being charged with corona discharge.

DESCRIPTION OF THE PREFERRED EMBODIMENTS

Figure 1:
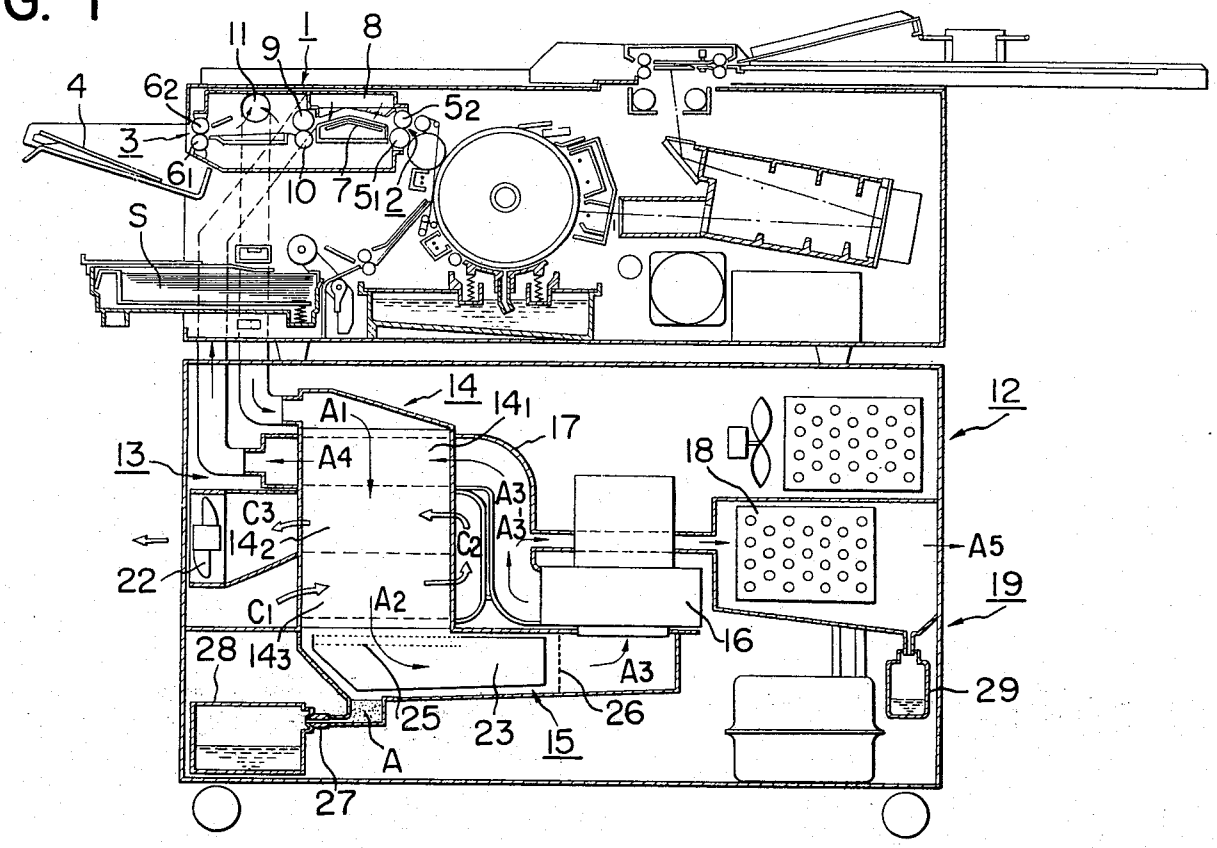
FIG. 1 is a schematic illustration of a copying machine which adopts an embodiment of the pesent invention.

Referring to FIG. 1, there is a shown an embodiment of the present invention. A transfer paper sheet S, which bears a visual image transferred from a photosensitive sheet or medium having an electrostatic latent image developed by means of developing liquid, may be admitted into a fixing-drying chamber 1 through an inlet port 2 and discharged therefrom through an outlet port 3 into a tray 4. The fixing-drying chamber is hermetically sealed as far as possible with its inlet and outlet ports 2 and 3 being sealingly closed by sealing rollers $5_1$, $5_2$ and $6_1$, $6_2$, respectively. When admitted into the fixing-drying chamber 1 through its inlet port 2, the transfer paper sheet S may be moved forward with its back side in intimate contact with a heated plate 7 having a heater contained therein and with its image-bearing surface exposed to the blast from a duct 8 for preparatory drying. Subsequently, the sheet S may pass between a heat roller 9 having a heater contained therein and press roller 10 so as to be dried and fixed with the carrier liquid completely vaporized.

A suction port 11 is provided in the latter half portion of the fixing-drying chamber 1 to direct the hot air with the carrier vapor into a recovery device 13 provided in a portion of a stand 12 for the copying machine. The air so directed into the recovery device 13 may then be passed through a heat-exchange condenser 14 and a mist collector 15 and sucked into a blower 16. The air is blown off from the blower 16 and passed through a duct 17 and a heat-exchanger $14_1$ into a duct 8, through which the air may again be blown off into the fixing-drying chamber 1. Thus, there is provided a circulation path. Part of the air may be divisionally directed by a duct 17 into a cooling chamber 18 such as a refrigerator, and then exhausted through an exhaust port 19.

In the above-described arrangement, air with carrier liquid in the fixing-drying chamber 1 is circulated by the blower 16, except for that part of the air which is exhausted through the exhaust port 19, so that the interior of the fixing-drying chamber 1 is below the atmospheric pressure. This prevents the air containing a high density of carrier vapor in the chamber 1 from leaking therefrom through some gaps the presence of which is actually unavoidable to such chamber. Rather, the chamber sucks a small amount of air thereinto through those gaps. It is an amount of air corresponding to or more than such a small amount of air that is exhausted through the exhaust port 19.

Figure 2:
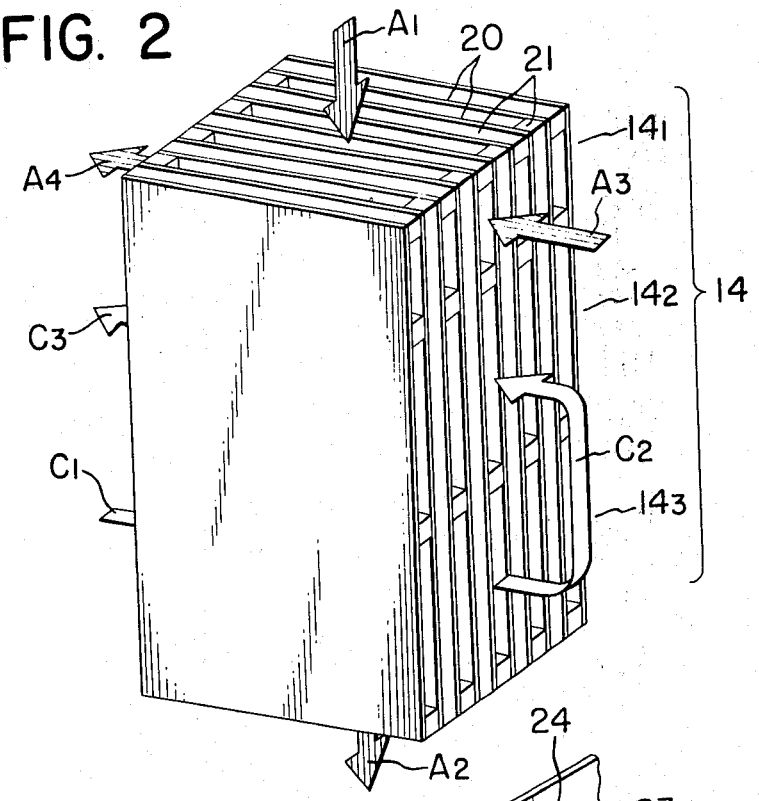
FIG. 2 is a perspective view showing a form of the heat-exchange condenser means.

The recovery of carrier liquid will now be described. The heat-exchange condenser 14, as is shown in FIG. 2, is an orthogonal flow type heat-exchanger comprising a plurality of sheets 20 of good heat-conductivity laminated with spacers 21 interposed therebetween. The cooling side of the condenser 14 is formed into three stages. The first stage $14_1$ is meant to cool the air down to the room temperature to recover the carrier liquid contained therein, and the air used as coolant therein is the air flow A3 which is to be returned to the fixing-drying chamber 1. In the second and third stages $14_2$ and $14_3$, ambient air flows C1, C2 and C3 sucked thereinto by a fan 22 (FIG. 1) are used as coolant. The hot air flow A1 containing a high density of carrier vapor directed from the fixing-drying chamber 1 is cooled down to a temperature near the room temperature as it is passed through the above-described heat-exchange condenser 14. As the cooling progresses, the carrier vapor in the air A1 is over-saturated so that part of such vapor is deposited on the walls of the condenser and progressively grown up into large drops of liquid, which finally fall from gravity. Most of the rest of the carrier vapor changes into minute particles which remain suspended as mist in the air. The air A2 containing the carrier mist and so cooled down to a temperature near the room temperature is then directed to the mist collector 15.

Figure 3:
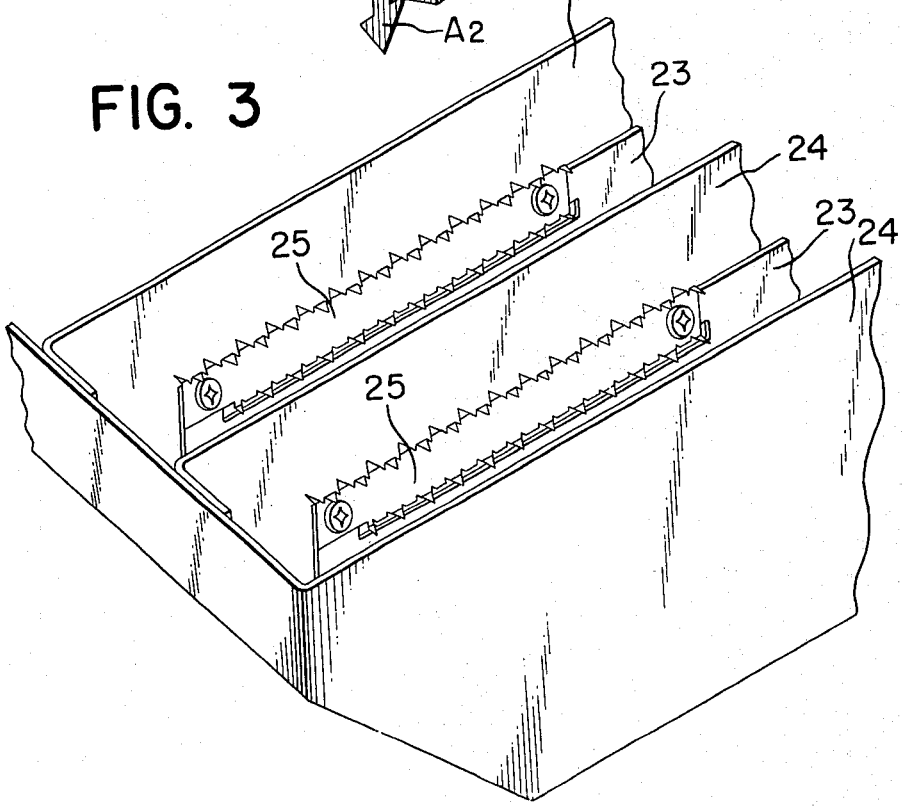
FIGS. 3 and 4 are fragmentary perspective views showing two forms of the mist collector means.

The mist collector 15, as is shown in FIG. 3, comprises electrode plates 23 with a high DC voltage applied thereto and grounded electrode plates or meshes 24, the plates 23 and meshes 24 being alternately arranged and suitable spaced apart for insulation from each other. Each electrode plate 23 has a needle discharge electrode 25 provided adjacent the entrance of the collector.

The mist suspended in the air A2 is passed through the corona discharge between each needle electrode and adjacent grounded electrode, whereby the mist is electrically charged. When passing through the subsequent field between the electrodes, the charged mist is attracted to the grounded electrode by Coulomb force and deposited thereon, so that the charged mist is neutralized for dripping. If the grounded electrode were in the form of a wall (FIG. 3), the entire wall surface of the grounded electrode would be covered with carrier liquid too rapidly for the charged mist to be well neutralized.

More particularly, the charged mist loses its charge after it has been deposited on the grounded electrode, and the speed at which the charged mist loses its charge is variable depending on the magnitude of the electrical resistance of the mist itself. If the entire wall surface of the grounded electrode is covered up with carrier liquid, the apparent electrical resistance of the charged mist will become higher even though the mist reaches the wall surface due to Coulomb force, thus reducing the speed at which the mist loses its charge (i.e. the speed at which the mist is neutralized). Moreover, as a large amount of charged mist gathers with the process of continuous copying, the quantity of charged mist overcomes the speed at which the charge is lost, and thus more and more of charged mist gathers there until it results in spark discharge. For this reason, the neutralization of charged mist must proceed at an appropriate speed.

Figure 4:
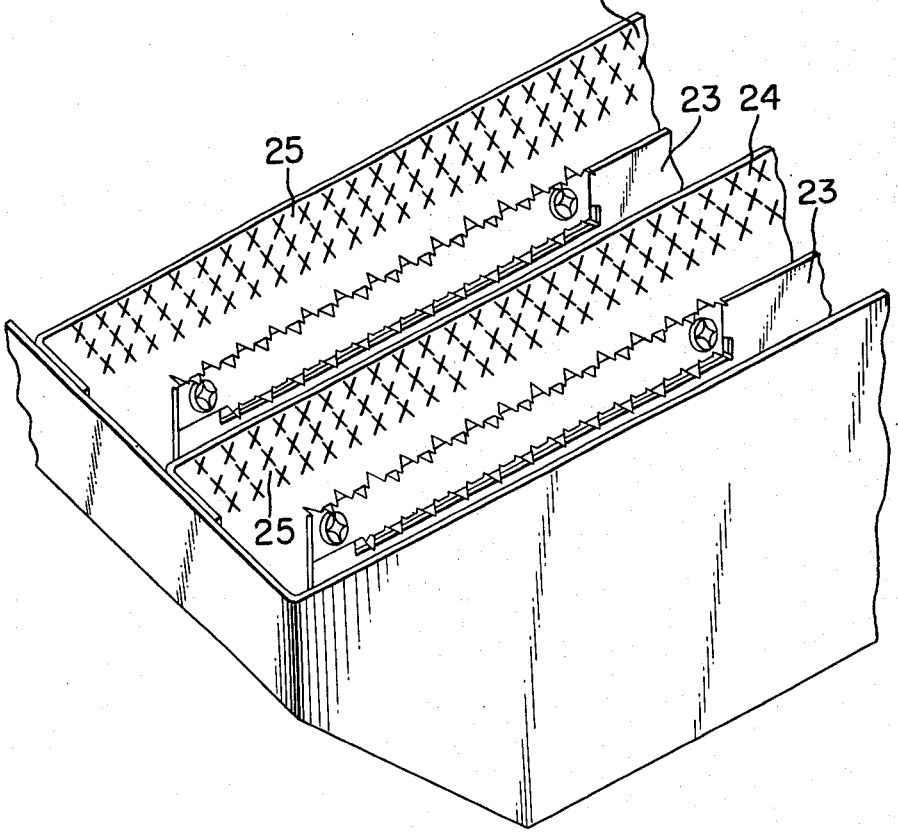

On the other hand, a grounded electrode in the form of mesh would never be thickly covered with carrier liquid. Further, the electrode in such form would ensure electrical neutralizatin of charged mist to proceed at an appropriate speed, thereby eliminating the above-described danger. FIG. 4 shows an example of the grounded electrode in the form of mesh.

By making the grounded electrodes in such mesh form, exhaust of the hygienically deleterious carrier vapor can be prevented substantially completely and the recovered carrier liquid can be reused, and this leads to the provision of a recovery device which is highly economical and highly safe. Substantially all (90% or more) of the mist in the air A2 is removed by the mist collector described above, while the slight amount of remaining mist is completely removed by a simple filter 26 such as wire netting or the like, and thus the air A3 now containing only a slight amount of carrier vapor (saturated vapor at room temperature) is returned to the fixing-drying chamber by the blower 16 for reuse.

The carrier liquefied by the heat-exchange condenser 14 and mist collector 15 may be collected through a discharge port 27 into a tank 28, from which the carrier liquid is returned to a developing device for reuse.

On the other hand, an air flow A3′ divided from the air flow A3 at the duct 17 is further cooled down in the cooling chamber 18 to an extreme extent so that substantially all of the carrier vapor in such air flow is liquefied, and then exhausted into the atmosphere. This exhaust air, indicated by A5, is of small amount and substantially clean, thus being never deleterious hygienically. The amount of carrier liquid resulting from the condensation in the cooling chamber 18 is collected in a tank 29, but the carrier liquid so collected in this tank 29 carries with it some water content of the air resulting from the condensation effected in the cooling chamber and cannot directly be reused. It must be regenerated before being reused.

The carrier liquid used with the electrophotographic copying machine of the liquid development type is a petroleum solvent generally known by the tradename of Isopar whose main component is isoparafine which is initially low in unsaturation degree and odorless. However, when the carrier liquid has been heated and vaporized in the fixing station after development or after image transfer and thereafter the carrier liquid has been recovered with the isoparafine vapor cooled and condensed, the polymerization chain of hydrocarbon is cut off under the influence of thermal cracking or the like to increase the unsaturation degree of isoparafine, as is well known. Moreover, the carrier liquid so recovered might further contain other ingredients resulting from the thermal cracking of the constituents forming the copy medium and thermal cracking of the constituents forming the developing liquid, and it is believed that the odor emitted from the recovered carrier liquid is attributable to the combination of those various ingredients, although the true cause has not yet been discovered definitely.

Nevertheless, the investigations into the method of deodorizing and purifying the recovered carrier liquid have shown that the unpleasant odor noted above can be almost completely removed by passing the carrier liquid through an absorbent such as active carbon, silica gel, active alumina, active magnesium, acid clay, bentonite, diatomite, calcium carbonate, titanium oxide or the like.

The present invention enables the repeated use of the recovered carrier liquid by employing one of the above-enumerated adsorbents as the adsorbent indicated at A in FIG. 1 so that the carrier liquid resulting from the active of the heat-exchange condenser and mist collector may pass through the adsorbent A.

Thus, the carrier liquid recovered in the abovedescribed manner is deodorized and safely available for reuse.

Figure 5:
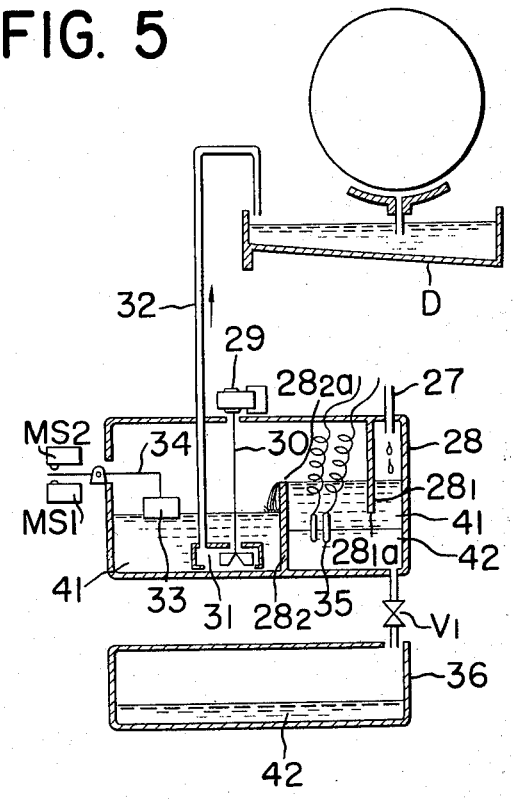
FIG. 5 shows a tank for recovered carrier liquid and a developing device.

FIG. 5 shows the details of the tank 28. The tank 28 for recovering the carrier vapor produced from the developing liquid and storing the thus recovered liquid includes a first partition wall $\mathbf{28_1}$ and a second partition wall $\mathbf{28_2}$ which serves to separate the recovered liquid until it reaches a predetermined liquid level. In the first chamber (right-hand side), the carrier liquid recovered by the recovery device is mixed with water and other impurities and the mixture drips into the tank 28 through the inlet 27. The first partition wall $\mathbf{28_1}$ serves to prevent the mixture of carrier liquid and water from running directly over the surface of the recovered liquid to go beyond the second partition wall, and for this purpose the lower end $\mathbf{28_{1a}}$ of the partition wall is at a lower level than at least the upper end $\mathbf{28_{2a}}$ of the second partition wall. The mixture of carrier liquid and water is first stored in the first chamber, where with lapse of time the mixture is completely separated into an upper layer of carrier liquid 41 and a lower layer of water 42 due to the difference in specific gravity (for example, if the carrier liquid is Isopar H, the ratio of specific gravity between the Isopar H and water is 0.75 : 1). As is already apparent, the carrier liquid forming the developer must be insulative and should not be mixed with water. It is for this reason that the carrier liquid and water are completely separated from each other in the first chamber, and thereafter when the liquid level exceeds a predetermined level, only the Isopar H liquid forming the upper layer is caused to overflow the top $\mathbf{28_{2a}}$ of the second partition wall $\mathbf{28_2}$ for collection in the second chamber (left-hand side). The carrier liquid so collected in the second chamber is delivered by a pump 31 driven from a motor 29 through the rotary shaft 30 thereof so as to be returned through a pipe 32 into a developer tank D which is the developer storage container of the developing means, thus becoming ready for reuse. In this case, however, the carrier liquid contains no developer and therefore, it is necessary to add a suitably concentrated developer to the stored liquid and control the density of the developing liquid by means of a toner density regulator or the like.

Figure 7:
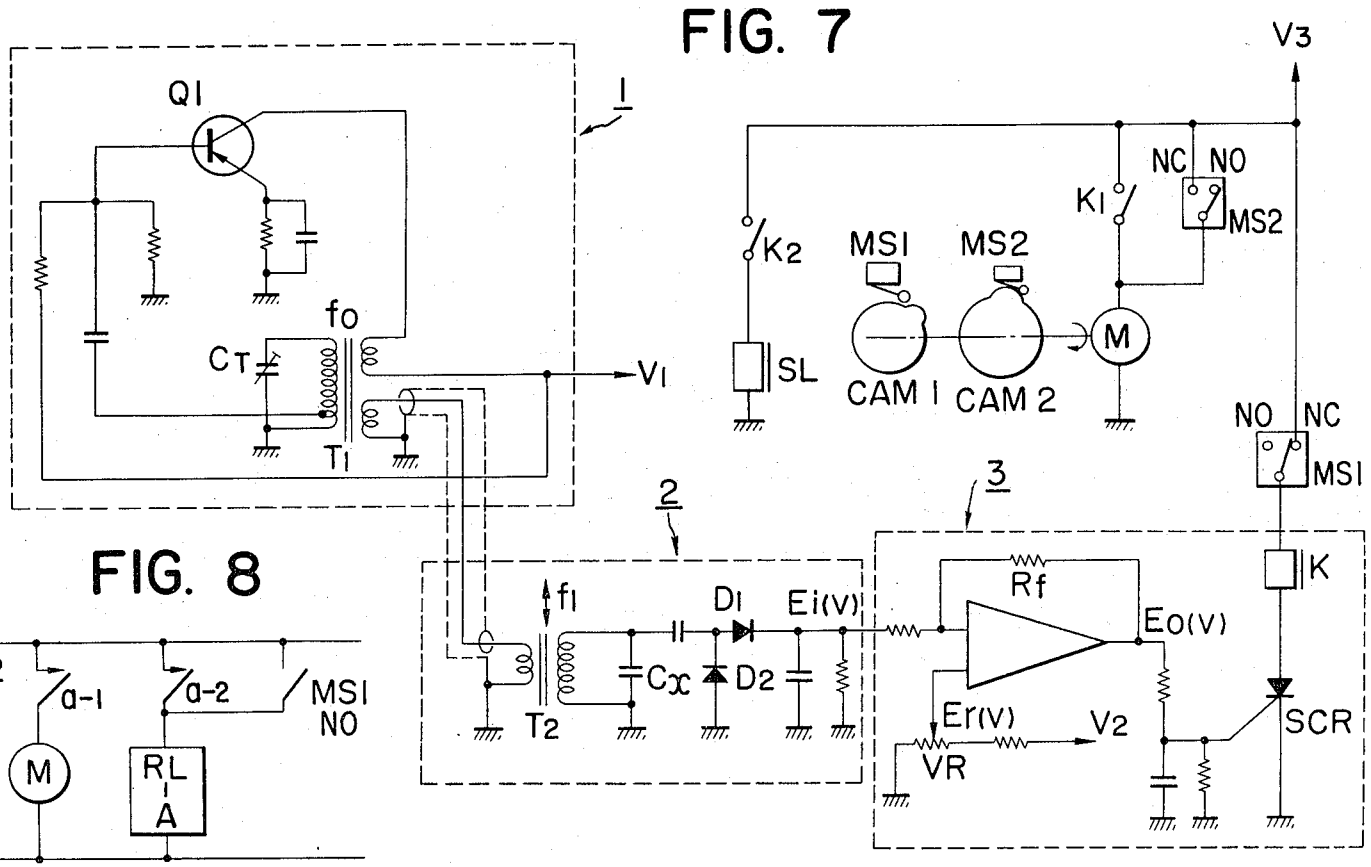
FIG. 7 is a diagram of the electric circuit in the device of the present invention.
Figure 8:
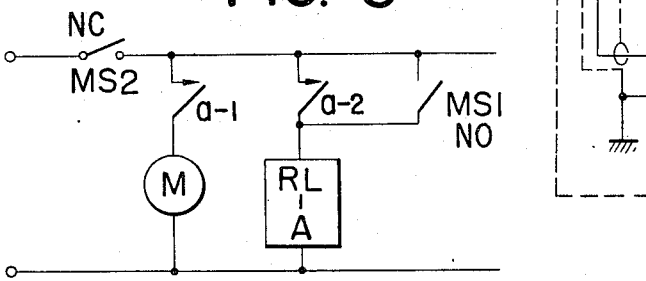
FIG. 8 is a circuit diagram of the liquid level detector means.

Within the recovered liquid tank 28 of the described construction, liquid level detector means is further provided in each of the first and second chambers. Especially, the water recovered and stored in the first chamber must not overflow the second partition wall $\mathbf{28_2}$ and for this reason, it is necessary to detect the liquid level of the lower layer when it exceeds a predetermined level and to remove the excess liquid. In FIG. 5, such detector means is designed to detect the level with the aid of the difference between the dielectric constant of carrier liquid and that of water, and comprises two conductive plates closely spaced and opposed to each other to detect the variation in induction coefficient therebetween. This circuit is shown in FIG. 7. When the water of the lower layer exceeds a predetermined level, an electrical signal is produced to open an electromagnetic valve V1 for a predetermined time to permit the water to fall into a tank 36 located below the tank 28. The electromagnetic valve V1 remains open until the water 42 sufficiently flows down, whereafter the valve is again closed to store the recovered liquid in the tank 28. In the second chamber, there is provided level detector means for controlling the liquid level within a predetermined range, and this level detector means includes a float 33, an actuator 34 actuated by the float 33, and microswitches MS1 and MS2 actuated by the actuator 34. Microswitch MS1 detects the upper limit of the liquid level and microswitch MS2 detects the lower limit of the liquid level. The operating circuit is shown in FIG. 8. As shown there, MS2 is a normally closed switch. When the float 33 rises to actuate the actuator 34 out of engagement from the microswitch MS2, the microswitch MS2 is closed. When the liquid level further rises to close the microswitch MS1, a relay RL-A is energized whose contact *a*-1 is thus closed to energize the motor 29, while in turn drives the pump 31 to pump the carrier liquid into the developing tank D. If this condition remains unchanged, the microswitch MS1 would immediately be opened to substantially prevent the carrier liquid 41 from being pumped up. To avoid this, the relay RL-A is held by its contact *a*-2 to maintain the motor energized irrespective of the opening of the switch MS1, and the motor M is not deenergized until the lower limit detector microswitch MS2 is opened, whereupon the pumping operation is stopped.

Figure 6:
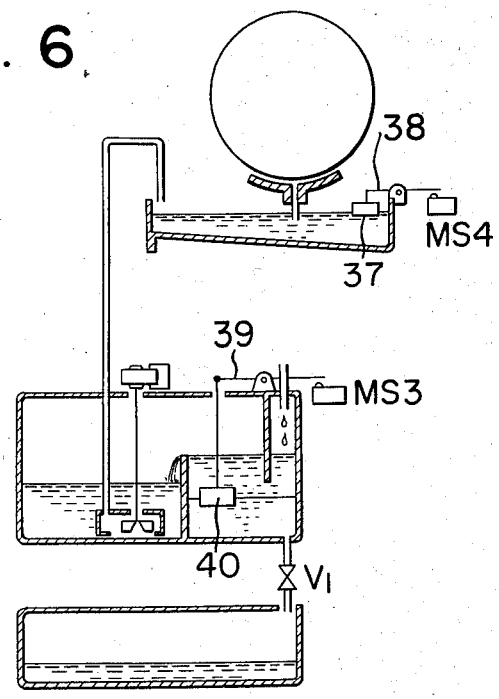
FIG. 6 schematically shows liquid level detector means provided in the tank and developing device of FIG. 5.

FIg. 6 shows liquid level detector means for detecting the liquid level of the lower layer within the first chamber by using a float 40 and a microswitch MS3. This utilizes the difference in specific gravity between the two liquid layers (0.75 : 1) and the float 40 is disposed in the interface between the two layers. When the float 40 exceeds a predetermined level, it actuates the switch MS3 to open the electromagnetic valve V1, thus permitting the liquid of the lower layer to fall into the underlying tank 36.

Further, in this embodiment, the developing tank D is provided with a liquid level detector microswitch MS4, a float 37 and an actuator 38. A great deal of carrier liquid (Isopar H) is prestored in the second chamber 28, and the carrier liquid (Isopar H) recovered by the recovery device is caused to overflow the first chamber to mix with the pre-stored carrier liquid in the second chamber. By the operation of the liquid level detector means of the developing tank D, the pump 31 is operated to supply the carrier liquid from the second chamber to the developing tank. The liquid pre-stored in the second chamber is not limited to carrier liquid but it may be developer with which the recovered carrier liquid may be mixed, and such mixture may be circulated to the developing device.

The electric circuit of FIG. 7 will now be explained. It More specifically a base tuning type oscillator circuit 1, a voltage doubling detector circuit 2, and a detection output amplifier circuit and thyristor trigger circuit 3 which varies the tuning frequency of the detector circuit in accordance with the variation in the capacitance of a capacitor Cx. The capacitance of the capacitor Cx is greater when the space between electrodes of the capacitor is filled with water than when such space is filled with air or Isopar, thus reducing the tuning frequency. The output voltage of the detector circuit can be higher as the turning frequency $f_1$ is closer to the frequency $f_2$ of the oscillator circuit, and this may be utilized to detect the level. More especially, if the oscillation frequency in the dotted frame 1 is $f_0$, the tuning frequency $f_1$ of $T_2$ is in the relation that $f_1$ $f_0$ with the capacitor Cx filled with water and the output voltages Ei and Er are regulated by a variable resistor VR to satisfy the relation Ei>Er, and the output voltage Eo is produced in the amplifier A. This is regulated so as to assume a sufficient value to trigger the thyristor SCR. When the thyristor SCR is triggered, the element K is energized to close the contacts K1 and K2 and thereby energize the motor M while the microswitch MS2 is a closed and the valve operating solenoid SL also energized to open the valve. As the motor M is rotated to cause the cam-1 to actuate and open the microswitch MS1, the thyristor SCR is turned off to deenergize the element K and open the contacts K1 and K2, thus deenergizing the solenoid SL and closing the valve. Irrespective of the opening of the contact K1, the motor M continues its rotation because the microswitch MS2 is closed, but when the cam-2 actuates the switch MS2, this switch is opened to deenergize the motor M in preparation for a subsequent operation.

The above-described construction of the present invention results in the advantages described below.

Exhaust of the hygienically deleterious carrier vapor into the atmosphere is substantially completely avoided and this ensures safety during a mass production of copies.

The recovered carrier liquid is available for reuse, which is a great economical advantage.

Since most of the air used for the fixing-drying process is cyclically used, the rate of recovery of the carrier is higher than when such cyclical use of the air is not adopted, and the heat-exchange condenser 14 need not be of so great a capacity. Also, the air A5 exhausted into the atmosphere is so small in amount that the cooler 18 may be of small capacity.

Since the heat-exchange condenser 14 is of the flat type and the mist collector 15 is of the corona discharge type, the flow path resistance is much less than in a filter type collector using steel wool or like material, and thus the blower in the flow path may be of small size.

The air A3 once used to recover the carrier is heated in the heat-exchanger $14_1$ and then used for the fixing-drying process to expedite such process, which means a thermal economy.

Further, the liquid containing carrier vapor from the developing station and from the fixing station can be recovered in the tank having the first and second partition walls and can be separated into carrier liquid and water due to their difference in specific gravity, whereafter the carrier liquid so separated can be returned to the developing tank for reuse. This leads to the provision of a highly economical device which permits reuse of the developing liquid.

We claim:

1. A developing liquid recovery device comprising:

a drying chamber which includes an inlet and an outlet for a copy medium and which is of substantially hermetically sealed construction, said drying chamber accommodating heating means for heating the copy medium bearing an image formed with a liquid developer to dry the copy medium, wherein a developing liquid vapor is produced from the copy medium;

a condenser chamber having a passage interconnecting said drying chamber therewith, wherein said condenser chamber is for accommodating means for cooling and liquefying the developing liquid vapor produced in said drying chamber;

means for circulating an air flow from said drying chamber through said passage to said condenser chamber and back to said drying chamber;

discharging means disposed downstream of said condenser chamber and upstream of said drying chamber with respect to said circulating air flow, said discharging means discharging a part of the air flow to maintain the pressure in said drying chamber at a lower value than that of the ambient pressure; and a separating container disposed with respect to said condenser chamber for receiving the developing liquid which has been liquefied by said cooling and liquefying means, said separating container including first discharging means for discharging a part of the liquefied developer of relatively high specific gravity and second discharging means for discharging a part of the liquefied developer of relatively low specific gravity.

2. A developing liquid recovery device according to claim 1 wherein said hermetically sealed construction is provided by transport rollers sealingly disposed in the inlet and outlet of said heating chamber.

3. A developing liquid recovery device according to claim 1, wherein said heating means includes a heated plate having a heat source contained therein.

4. A developing liquid recovery device according to claim 1, wherein said heating means includes a heat roller.

5. A developing liquid recovery device according to claim 1, wherein said condenser chamber includes cooling means, and wherein the air which has passed through said condenser chamber from said drying chamber is subsequently passed through the cooling means of said condenser chamber by said circulating means.

6. A developing liquid recovery device according to claim 1, wherein said condenser chamber includes cooling means which utilizes ambient air.

7. A developing liquid recovery device according to claim 1, further comprising means for directing the developing liquid liquefied in said condenser chamber and received in said separating chamber to developer means to use the developing liquid repeatedly.

8. A developing liquid recovery device according to claim 1 wherein said separating container includes a partition wall therein for dividing the container into two chambers which are in communication with each other at a lower portion of the partition wall.

9. A developing liquid recovery device according to claim 1, further comprising means for detecting a predetermined level of the liquid in said separating container, and means for permitting discharging of the liquid through said first discharging means of said separating container in response to the detection of the predetermined level by said detecting means.

10. A developing liquid recovery device according to claim 1, wherein said second discharging means is an opening permitting overflow of the liquid, said device further comprising a second container for accommodating the liquid which has overflow from said opening, second detecting means for detecting a predetermined level of the liquid in said second container, and means for feeding the liquid within said second container to a developing station.

11. A developing liquid recovery device according to claim 9, wherein said first level detecting means includes a dielectric constant detector.

12. A developing liquid recovery device according to claim 9, wherein said first level detecting means includes a floating member.

* * * * *

UNITED STATES PATENT AND TRADEMARK OFFICE

CERTIFICATE OF CORRECTION

PATENT NO. : 3,997,977

DATED : DECEMBER 21, 1976

INVENTOR(S) : HAJIME KATAYAMA, KOICHI MIYAMOTO, SHOJI OHASHI

It is certified that error appears in the above–identified patent and that said Letters Patent are hereby corrected as shown below:

Column 7, line 56, delete "More specifically" and insert --includes--.

Column 8, line 2, after "$f_1$" insert -- $\cong$ --. (second occurrence)

Signed and Sealed this

First Day of March 1977

[SEAL]

*Attest:*

RUTH C. MASON
*Attesting Officer*

C. MARSHALL DANN
*Commissioner of Patents and Trademarks*